US005967911A

United States Patent [19]

McAvoy

[11] Patent Number: 5,967,911

[45] Date of Patent: Oct. 19, 1999

[54] BASKETBALL REBOUND DEVICE

[76] Inventor: Oliver D McAvoy, 215 Valencia Blvd., apt. 501, Jacksonville, N.C. 28546

[21] Appl. No.: 09/046,207

[22] Filed: Mar. 23, 1998

[51] Int. Cl.[6] ..... A63B 69/00

[52] U.S. Cl. ..... 473/435; 273/342; 273/396; 473/447

[58] Field of Search ..... 473/435, 431, 473/447, 432, 433, 434; 273/342, 394, 396

[56] References Cited

U.S. PATENT DOCUMENTS 3,236,520 2/1966 Friedman .
4,093,218 6/1978 Burchers .
5,141,224 8/1992 Nolde et al. .
5,460,382 10/1995 Loritz ..... 273/342
5,467,977 11/1995 Beck .
5,524,900 6/1996 Allen ..... 273/396
5,556,104 9/1996 Guillen, Jr. .
5,558,338 9/1996 Taub ..... 473/435 X

*Primary Examiner*—William H. Grieb
*Attorney, Agent, or Firm*—Michael I. Kroll

[57] ABSTRACT

A basketball rebound device (14) comprising a wedge shaped ramp (16). A component (18) is on a top surface of the wedge shaped ramp (16) for deflecting a basketball (20), when the wedge shaped ramp (16) is positioned upon a basketball court (22) under a hoop (24) on a backboard (26) suspended from a stanchion (28) on the basketball court (22). The basketball (20) will bounce back to a desired area where a person is standing doing practice shooting, allowing the person to spend more time practicing and less time retrieving the basketball (20).

1 Claim, 9 Drawing Sheets

BASKETBALL REBOUND DEVICE

BACKGROUND OF THE INVENTION

1. Field of the Invention

The instant invention relates generally to athletic training equipment and more specifically it relates to a basketball rebound device. The basketball rebound device will help a person when practicing shooting a basketball into a basket. As the basketball descends through the hoop, it will land on a wedge shaped ramp on the basketball court underneath the hoop and bounce back to a desired area, where the person is standing. The wedge shaped ramp is lightweight and includes a pair of cutout handles, so that it can be easily carried by the cutout handles to and from the basketball, court, while being effortlessly positioned and repositioned during a practice session.

2. Description of the Prior Art

Numerous athletic training equipment have been provided in prior art. For example, U.S. Pat. Nos. 3,236,520 to Friedman; 4,093,218 to Burchers; 5,141,224 to Nolde et al.; 5,467,977 to Beck and 5,556,104 to Guillen, Jr. all are illustrative of such prior art. While these units may be suitable for the particular purpose to which they address, they would not be as suitable for the purposes of the present invention as heretofore described.

FRIEDMAN, SOL J.

PORTABLE BASEBALL TRAINING MOUND FOR PITCHERS

U.S. Pat. No. 3,236,520

A portable pitcher's mound comprising a body of foamed plastic material having a top working surface higher at the rear than at the forward end. The surface has a portion at the rear substantially horizontal to the plane of the underside of the body and a forward end portion curving forwardly and downwardly and terminating at the forward end in a sharply downwardly curved front end portion. The rear and sides of the body curve downwardly and outwardly from the top playing surface. A pitcher's plate is on the top of the mound and extends transversely of the mound adjacent the rear end of the top surface. A shield comprising a sheet of rubber extends from the plate forwardly on the top surface and terminates adjacent the forward end thereof. The shield has substantial width and is secured to the top surface of the body by an adhesive for protection of the top surface against wear and damage from the shoes of the player using the mound. The shield has a plurality of transversely extending parallel lines spaced apart longitudinally relative to the mound and spaced forwardly of the pitcher's plate.

BURHERS, SAMUEL A.

MODULAR BALL REBOUND APPARATUS

U.S. Pat. No. 4,093,218

A modular ball rebound apparatus to assist a beginner or a serious tennis player to improve his or her game. The apparatus is comprised of a plurality of panels for removable mounting on an easel which is adjustable to vary the angle of inclination of the panels to vary the speed, bounce and elevation of the return of a ball after striking one of the panels. The surfaces of which are coated with an energy absorbing material to control the speed of the return.

NOLDE, BART D.

NOLDE, BYRON C.

MILLER, PATRICK F.

BASKETBALL RETURN DEVICE

U.S. Pat. No. 5,141,224

A basketball deflection device is disclosed for a basketball goal assembly. The basketball deflection device comprises a mounting section and a deflector section. The mounting section has a first end which is attachable to the basketball goal assembly, and a second end having a preformed slot therethrough. The deflector section has a first end which is insertable through the performed slot of the second end of the mounting section to removably secure the deflector section to the mounting section. A second end of the deflector section is adapted to deflect the basketball away from the basketball goal assembly when a successful shot is made. Optionally, a bolt is provided to more permanently fasten the deflector and mounting sections together.

BECK, JOHN W.

PORTABLE PITCHING MOUND

U.S. Pat. No. 5,467,977

A lightweight portable pitching mount for indoor and outdoor use. The mound comprises an expanded plastic core, all exposed surfaces of which are covered with a flexible, sheet-like artificial turf material. The bottom of the mound is planar and preferably covered with an anti-slip material when the mound is used indoors. In a first embodiment, the mound comprises a single, unitary, one-piece, ramp-like structure having a top surface with a planar horizontal part and a planar part extending forwardly and downwardly therefrom. The mount has vertical front, rear and side peripheral surfaces. The top surface parts and the peripheral surfaces are covered with the artificial turf material. The top surface horizontal part supports a conventional rubber. In a second embodiment, the mound comprises three pieces, a central and two side sections which, when assembled in side-by-side abutting relationship, form a rectangular mound having narrow, vertical, rectilinear side, front and rear peripheral edges. The central section has a planar, horizontal, rectilinear, top surface part supporting a conventional rubber and having front, rear and side edges parallel to the corresponding front, rear and side peripheral mount edges. The central and side sections, when assembled, having top surface parts forming four planar trapezoidal surfaces, each sloping downwardly and outwardly from an edge of the horizontal top surface part to the corresponding peripheral edge of the mound. The top surface parts and the peripheral edges of the mound are covered with the artificial turf material.

GUILLEN, JR., JOSE E.

SOCCER PRACTICE DEVICE

U.S. Pat. No. 5,556,104

A practice device is provided for practicing soccer ball kicking and passing techniques comprising essentially a frame and a rebound surface and optional netting. When the practice device is positioned at a certain distance from the practicing student and the soccer ball is kicked or passed to the practice device, the soccer ball impacts the solid upright portion of the device and then rebounds back to the soccer student, thereby challenging his kicking accuracy and response reflex while minimizing his efforts to retrieve the soccer ball. The device is particularly suitable for the training of younger students to improve their soccer skills and technical abilities.

SUMMARY OF THE INVENTION

A primary object of the present invention is to provide a basketball rebound device that will overcome the shortcomings of the prior art devices.

Another object is to provide a basketball rebound device that will help a person when practice shooting a basketball into a basket, whereby as the basketball descends through the hoop, it will land on a wedge shaped ramp on the basketball court underneath the hoop and bounce back to a desired area where the person is standing.

An additional object is to provide a basketball rebound device in which the wedge shaped ramp is lightweight and includes a pair of cutout handles, so that it can be easily carried by the cutout handles to and from the basketball court, while being effortlessly positioned and repositioned during a practice session.

A further object is to provide a basketball rebound device that is simple and easy to use.

A still further object is to provide a basketball rebound device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
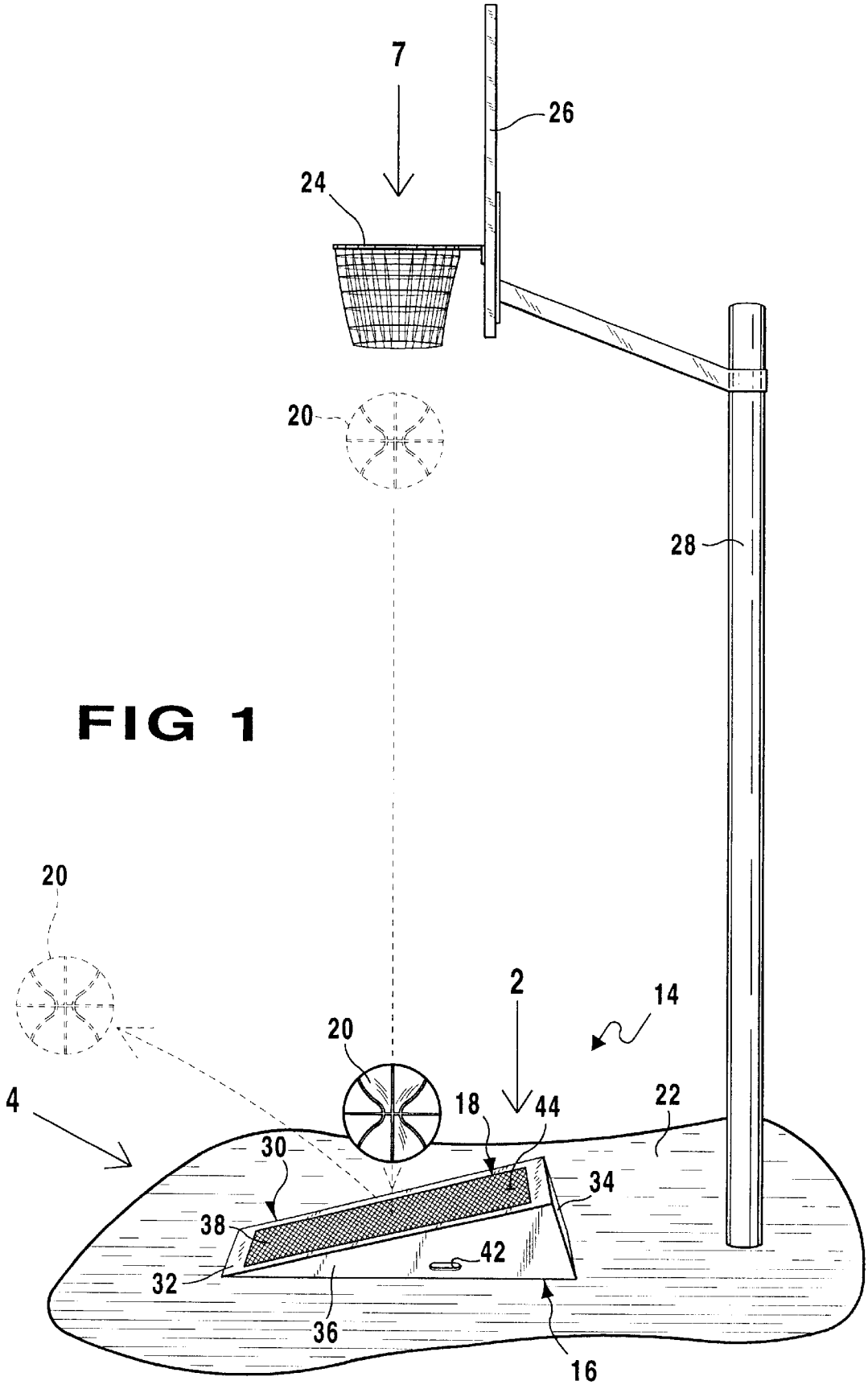
FIG. 1 is a side perspective view, showing the present invention in use, placed upon a basketball court underneath the basket.
Figure 2:
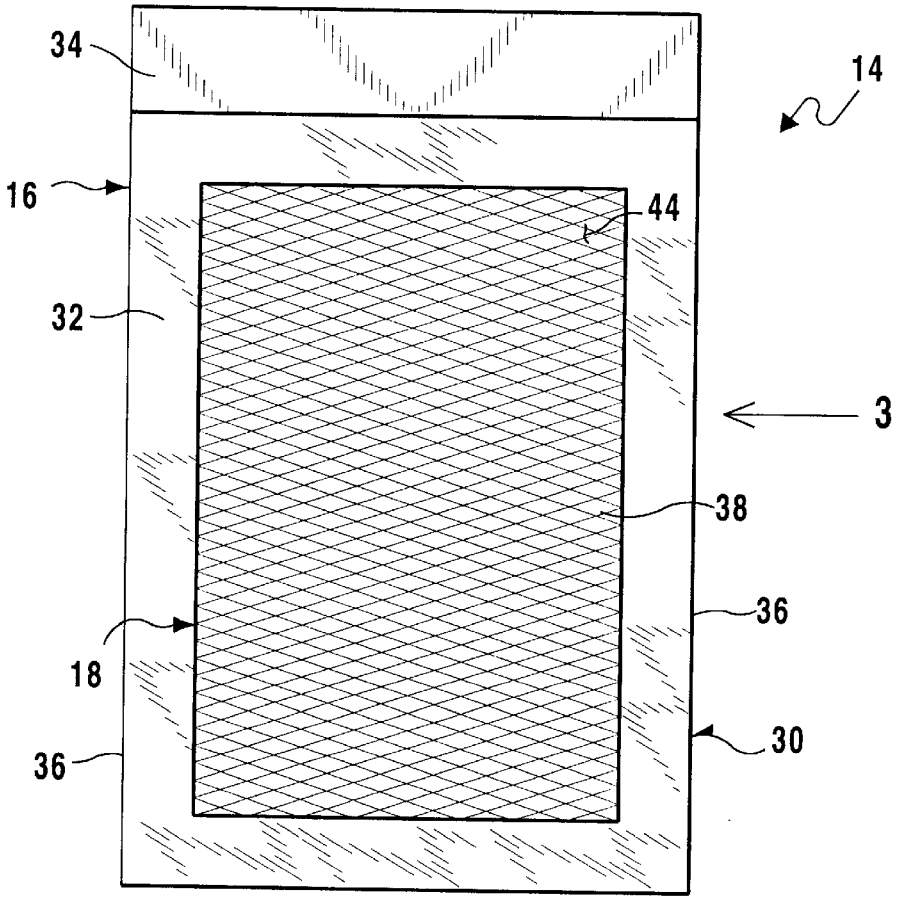
FIG. 2 is a top plan view of the present invention per se, taken in the direction of arrow 2 in FIG. 1.
Figure 3:
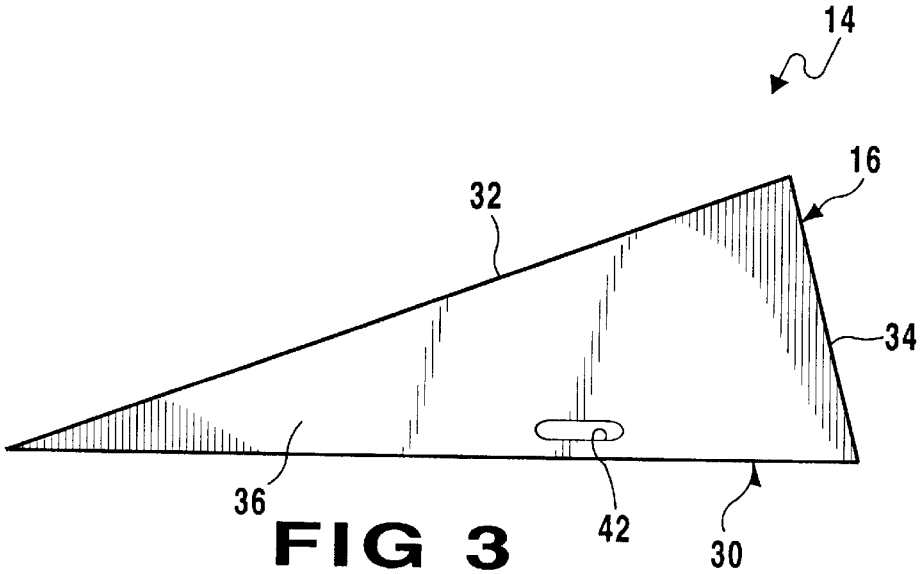
FIG. 3 is a side elevational view, taken in the direction of arrow 3 in FIG. 2.
Figure 4:
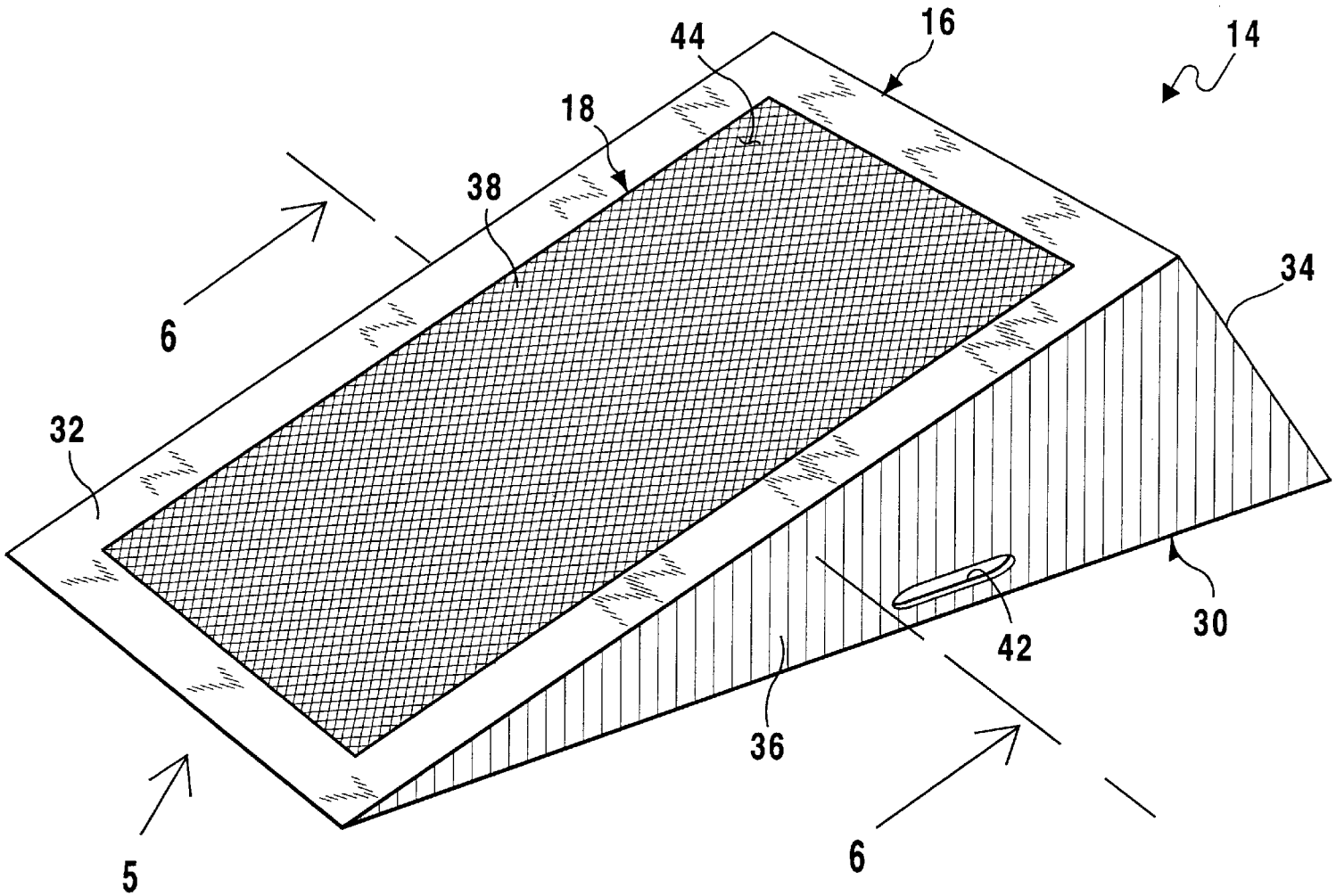
FIG. 4 is a top perspective view of the present invention per se, taken in the direction of arrow 4 in FIG. 1.

Turning now descriptively to the drawings, in which similar reference characters denote similar elements throughout the several views, FIGS. 1 through 12 illustrate the present invention being a basketball rebound device 14. With regard to the reference numerals used, the following numbering is used throughout the various drawing figures.

14 basketball rebound device
16 wedge shaped ramp of 14
18 deflecting component of 14 on 16
20 basketball
22 basketball court
24 hoop on 26
26 backboard on 28
28 stanchion on 22
30 lightweight rigid framework for 16
32 inclined top wall of 16
34 rear wall of 16
36 triangular side wall of 16
38 deflector plate
40 strong plastic material for 16
42 cutout handle in 36
44 top traction surface on 38
46 elastomeric material for 38 and 54
48 ribbed grid under structure of 16
50 center triangle support partition
52 planar bottom wall of 16
54 non-skid sheet on 52

The basketball rebound device 14 comprises a wedge shaped ramp 16. A component 18 is on a top surface of the wedge shaped ramp 16, for deflecting a basketball 20, when the wedge shaped ramp 16 is positioned upon a basketball court 22 under a hoop 24 on a backboard 26 suspended from a stanchion 28 on the basketball court 22. The basketball 20 will bounce back to a desired area where a person is standing doing practice shooting, allowing the person to spend more time practicing and less time retrieving the basketball 20.

The wedge shaped ramp 16 is a lightweight rigid framework 30. The wedge shaped ramp 16 includes an inclined top wall 32. A rear wall 34 extends downwardly from the inclined top wall 32. A pair of triangular side walls 36 extend downwardly from the inclined top wall 32.

The deflecting component 18 is a deflector plate 38 imbedded into a top surface of the inclined top wall 32 of the wedge shaped ramp 16, which will aid in removing any remaining spin on the basketball. The wedge shaped ramp 16 is fabricated out of a strong plastic material 40.

Each triangular side wall 36 has a cutout handle 42. The wedge shaped ramp 16 can be easily carried by the cutout handles 42 to and from the basketball court 22, while being effortlessly positioned and repositioned during a practice session.

The deflector plate 38 includes a top traction surface 44, which will induce the basketball 20 by friction to travel in the direction that the inclined top wall 32 is facing (see FIGS. 1, 7, 8 and 9). The deflector plate 38 is fabricated out of an elastomeric material 46.

Figure 5:
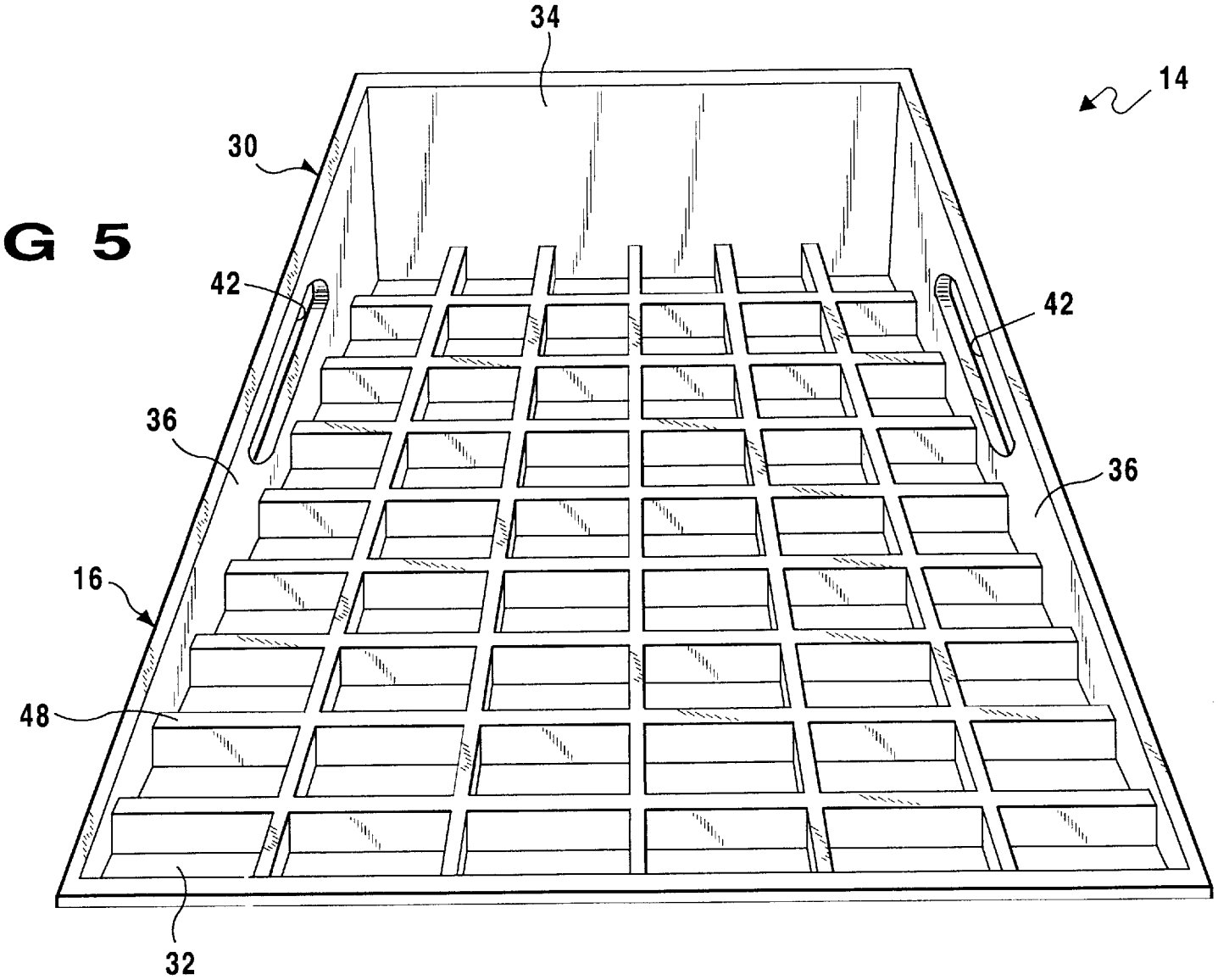
FIG. 5 is a bottom perspective view, taken in the direction of arrow 5 in FIG. 4.
Figure 6:
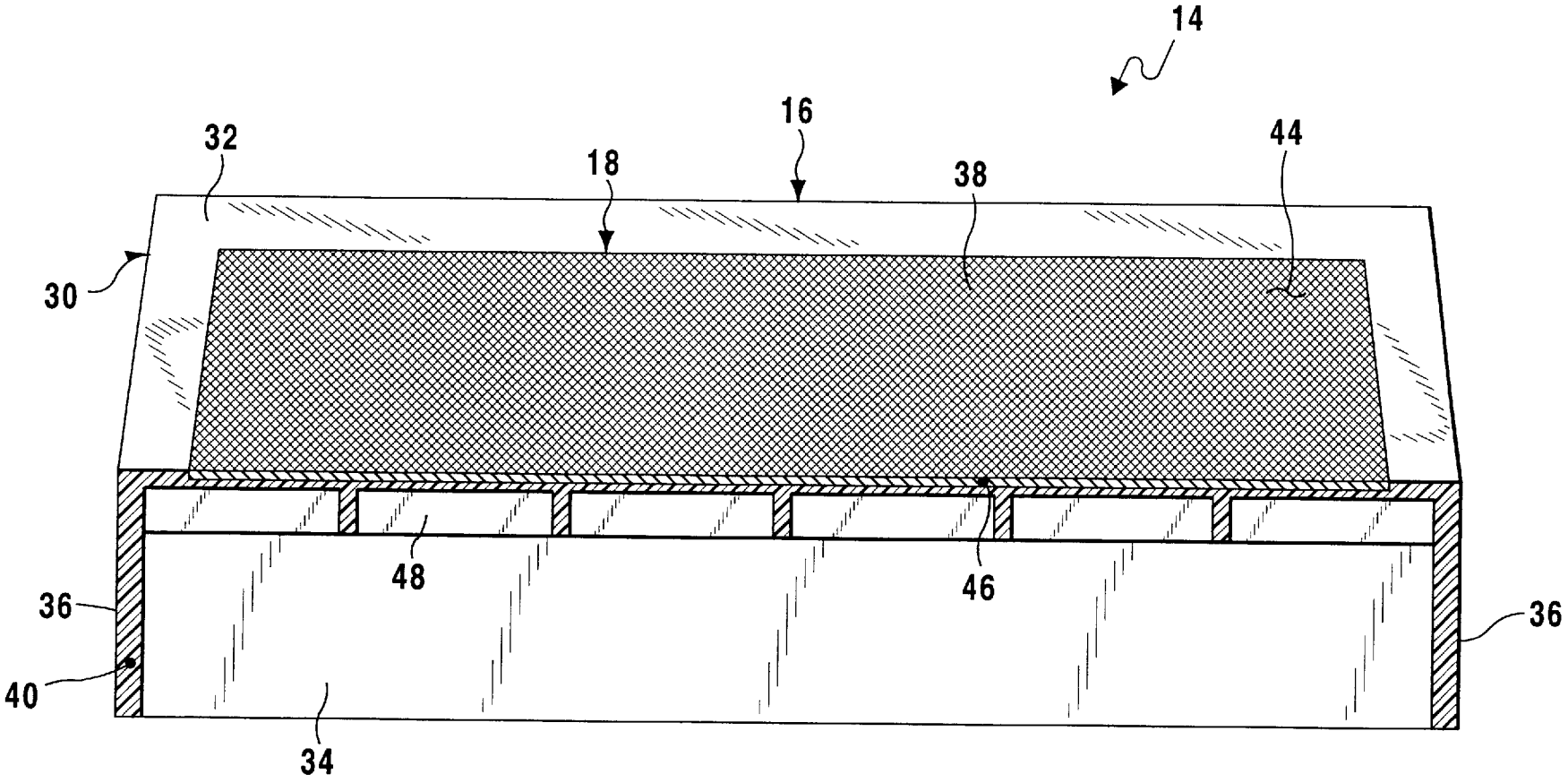
FIG. 6 is a cross sectional view, taken along line 6—6 in FIG. 4.
Figure 9:
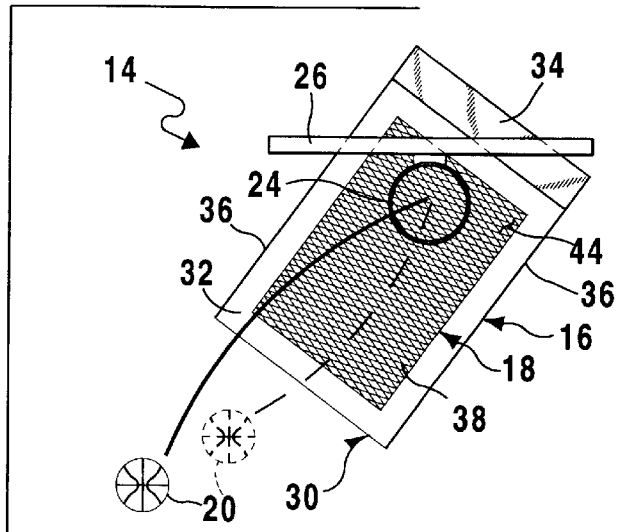
FIG. 9 is a diagrammatic top plan view similar to FIG. 7, with the present invention positioned towards the left sideline of the basketball court.
Figure 8:
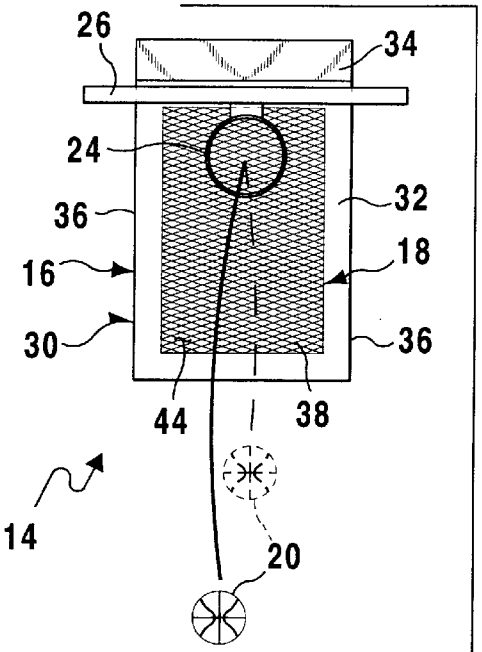
FIG. 8 is a diagrammatic top plan view similar to FIG. 7, with the present invention positioned straight towards the foul line of the basketball court.
Figure 7:
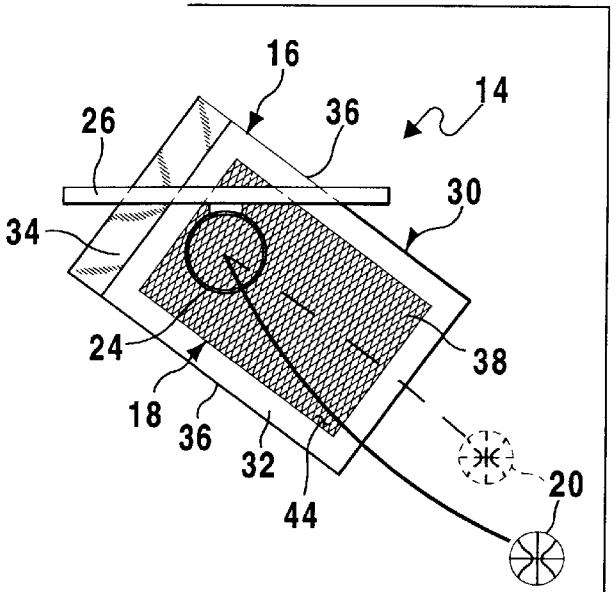
FIG. 7 is a diagrammatic top plan view, taken in the direction of arrow 7 in FIG. 1, with the present invention positioned towards the right sideline of the basket ball court.
Figure 10:
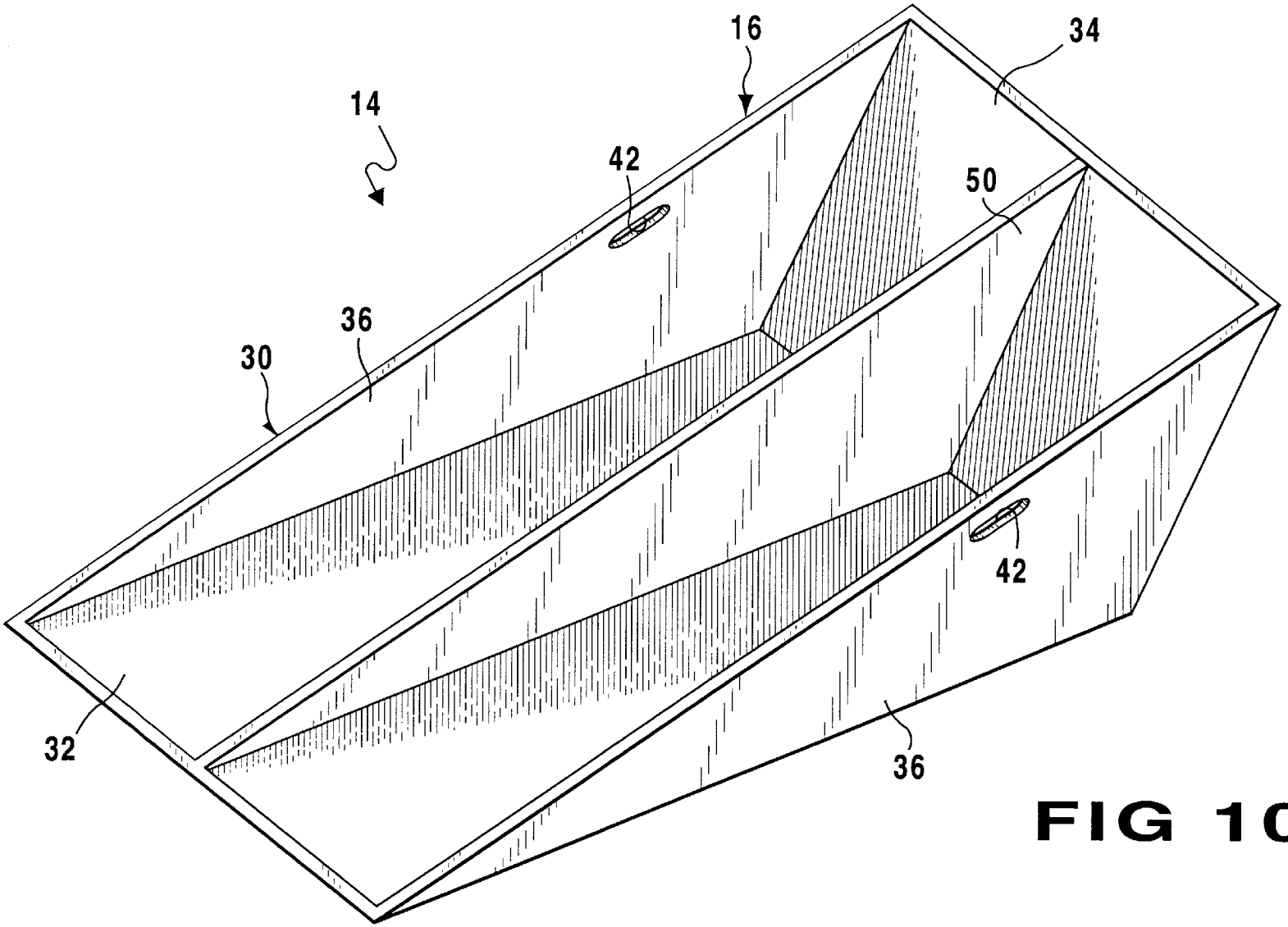
FIG. 10 is a bottom perspective view of a second embodiment of the present invention.

The wedge shaped ramp 16, as shown in FIGS. 5 and 6, can further include a ribbed grid under structure 48 on a bottom surface of the inclined top wall 32, to add rigidity thereto. The wedge shaped ramp 16, as shown in FIGS. 10, 11 and 12, can further include a center triangular support partition 50 extending downwardly from a bottom surface of the inclined top wall 32, to add rigidity thereto.

Figure 11:
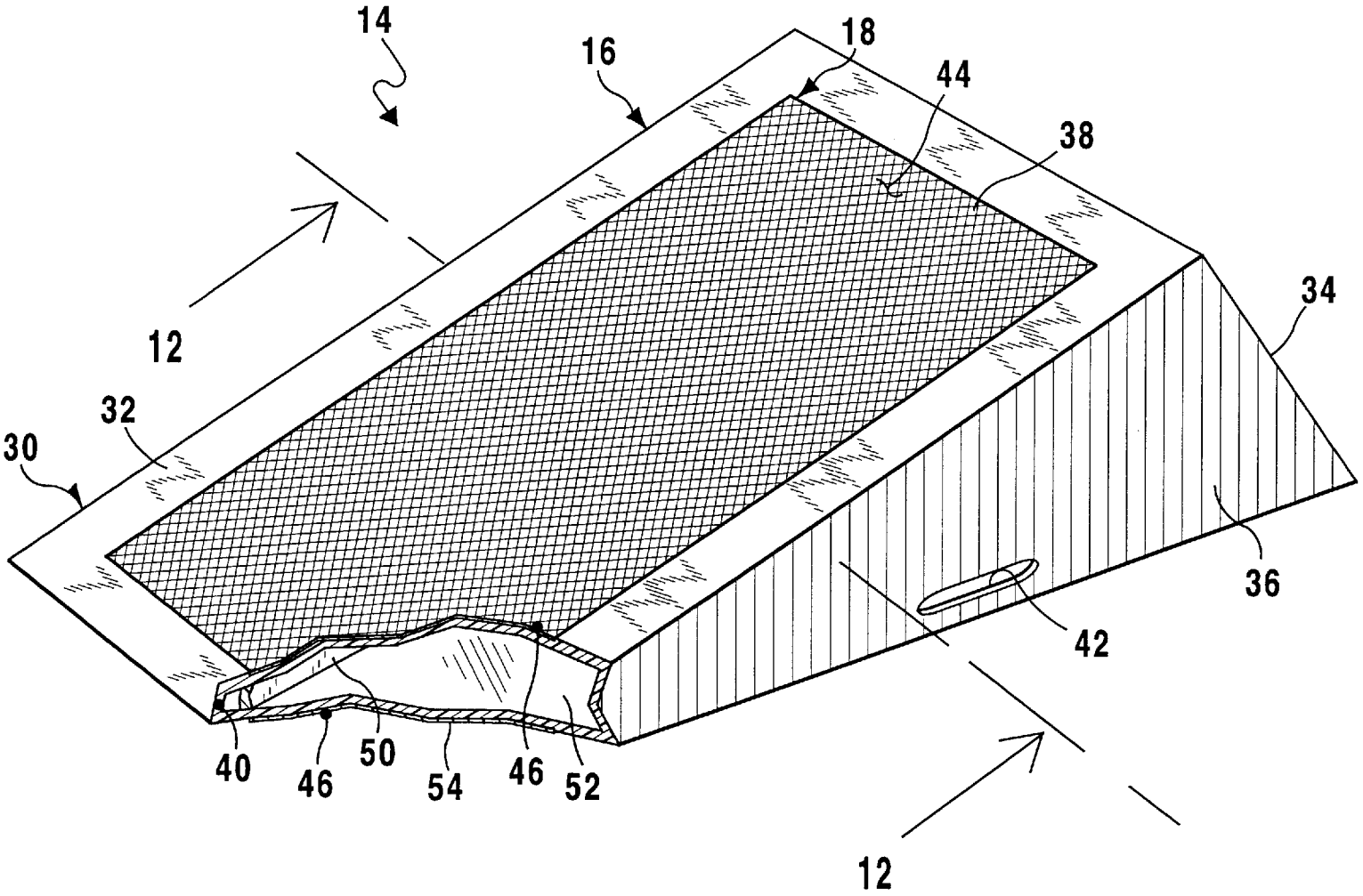
FIG. 11 is a top perspective view of a third embodiment of the present invention with parts broken away and in section.
Figure 12:
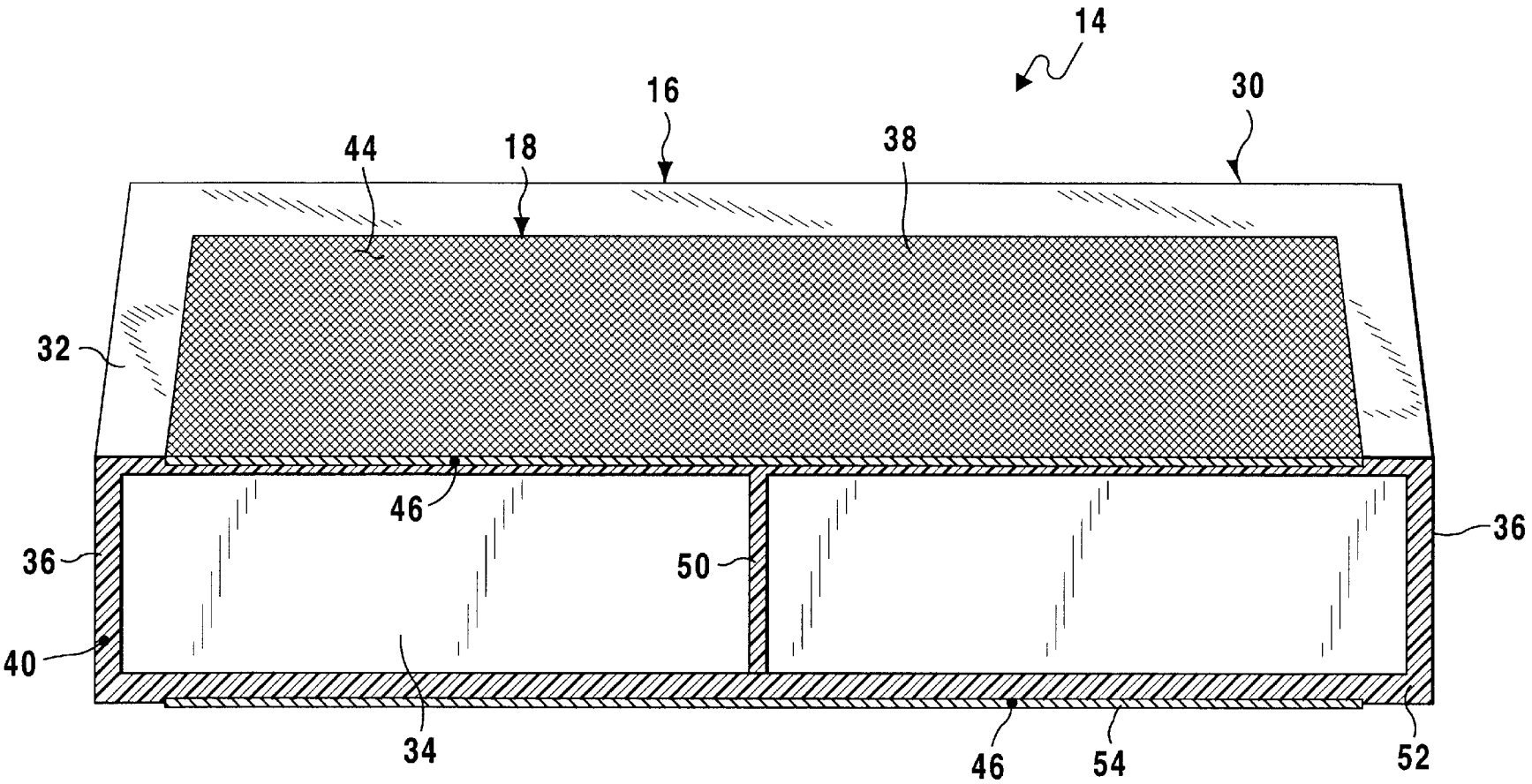
FIG. 12 is a cross sectional view taken along line 12—12 in FIG. 11.

In FIGS. 11 and 12, the wedge shaped ramp 16 further contains a planar bottom wall 52. A non-skid sheet 54 is imbedded into a bottom surface of the planar bottom wall 52, to prevent the wedge shaped ramp 16 from sliding upon the basketball court 22, when the basketball 20 impacts the deflecting component 18. The non-skid sheet 54 is fabricated out of the elastomeric material 46, to provide a gripping surface on the basketball court 22 and also act to absorb the impact from the basketball 20.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of retrieving basketballs comprising the steps of:

a) placing a wedge shaped ramp having an inclined top surface located on the ground directly beneath a basketball hoop mounted on a backboard suspended from a fixed stanchion, said top surface having embedded therein a deflector plate with a top friction surface for deflecting and reducing the spin of said basketball and a bottom surface with a non-skid sheet embedded therein to prevent said ramp from sliding under the impact of a basketball; and b) orienting said ramp with respect to said backboard to direct said basketball in a preselected direction when said basketball passes through said hoop.

* * * * *